US005107097A

United States Patent [19]

Negandhi et al.

[11] Patent Number: 5,107,097

[45] Date of Patent: Apr. 21, 1992

[54] FORCED AIR CONVECTION OVEN

[75] Inventors: Dipak J. Negandhi, Rockton, Ill.; Jeffrey S. McMahon, Beloit, Wis.

[73] Assignee: Specialty Equipment Companies, Inc., Rockton, Ill.

[21] Appl. No.: 609,172

[22] Filed: Nov. 5, 1990

[51] Int. Cl.[5] ..... F27D 11/00; A21B 1/00

[52] U.S. Cl. ..... 219/400; 219/385; 219/386; 126/21 A; 126/21 R

[58] Field of Search ..... 219/385, 386, 400; 126/338, 339, 21 A, 21 R, 18

[56] References Cited

U.S. PATENT DOCUMENTS

| | | | |
|---|---|---|---|
| 1,943,575 | 11/1934 | Abendroth | 219/400 |
| 2,897,746 | 8/1959 | Hilgers | 126/338 |
| 3,552,299 | 1/1971 | Patoka | 99/339 |
| 3,782,892 | 1/1974 | Johnson et al. | 126/21 A |
| 3,827,346 | 8/1974 | Tropp et al. | 219/400 |
| 3,861,378 | 1/1975 | Rhoads et al. | 219/400 |
| 3,905,760 | 9/1975 | Johansson et al. | 219/400 |
| 3,978,843 | 9/1976 | Durth | 219/400 |
| 4,051,347 | 9/1977 | Rohrl et al. | 219/400 |
| 4,132,216 | 1/1979 | Guibert | 219/400 |
| 4,244,979 | 1/1981 | Roderick | 426/418 |
| 4,315,137 | 2/1982 | Dahms | 219/391 |
| 4,327,279 | 4/1982 | Guibert | 219/400 |
| 4,348,948 | 9/1982 | Allison | 126/18 |
| 4,357,522 | 11/1982 | Husslein et al. | 219/400 |
| 4,397,875 | 8/1983 | Gilliom | 219/400 |
| 4,460,332 | 7/1984 | Lawler et al. | 432/72 |
| 4,515,143 | 5/1985 | Jabas | 219/400 |
| 4,627,409 | 12/1986 | Kagomoto | 219/400 |
| 4,722,683 | 2/1988 | Royer | 432/152 |

FOREIGN PATENT DOCUMENTS

| | | | |
|---|---|---|---|
| 2131259 | 6/1984 | United Kingdom | 219/400 |

*Primary Examiner*—Marvin M. Lateef
*Assistant Examiner*—Tuan Vinh To
*Attorney, Agent, or Firm*—Vernon J. Pillote

[57] ABSTRACT

A forced air convection oven having an open front and a door for closing the open front, a centrifugal air circulating blower on a horizontal axis located generally centrally on the rear wall of the cavity with heaters adjacent the rear wall for heating the air circulated by the blower. An air distributor cage unit is mounted for removal as a unit through the front opening in the housing and the top, bottom and opposing side panels of the cage have a multiplicity of air discharge openings therein for passing air into the cage for flow therethrough to the return outlet in the rear wall. A food tray support rack is mounted for rotation about a vertical axis in the cage and is removable through the opening in the front of the cage for cleaning.

8 Claims, 4 Drawing Sheets

M
31
10
32
34
E
44
36
45
B
11
H
33
79
12
78a
78b
81b
81
82
82a
83
91
49a
81a
86
78
61a
46a
C
49
47a
62a
62
85
71a
71b
71c
71d
R
Q
61
52
D

FORCED AIR CONVECTION OVEN

BACKGROUND OF THE INVENTION

The present invention relates to forced air convection ovens and particularly to ovens for heating, browning and reconstituting or finish cooking of food products that have been at least partially precooked and then frozen for storage. Forced air convection ovens generally have a fan or blower for recirculating air over a heater and through the oven compartment that contains the food which is to be heated or finish cooked. A major problem in forced air convection ovens has been to obtain uniform heating and finish cooking of the food products in the oven, and this problem is aggravated when cooking food products at two or more levels at the same time in the oven compartment. When heated air is directed into the oven cavity only at the sides of oven cavity, food products placed on the peripheral region of the food trays are subjected directly to the hot air flows while food products in the middle region of the tray are heated after the hot air flows have been baffled and cooled somewhat by contact with the food products on the peripheral portions of the tray such that there is a difference in heating of the food products in the different portions of the tray.

Cleaning is another problem in forced air convection ovens. Forced air convection ovens usually provide baffles and or passages for controlling distribution of air flows from the blower to the oven cavity and oils, vapors and food particles are circulated with the heated air and tend to deposit and collect in various areas which are not accessible for cleaning in prior ovens. Such deposits, if not periodically removed, can adversely affect the atmosphere in the oven during subsequent cooking operations and impart undesired flavors to the food products being cooked.

SUMMARY OF THE INVENTION

It is an object of the present invention to provide a forced air convection oven having an improved arrangement for directing and controlling flow of heated air through the oven compartment to achieve more uniform heating, browning and cooking of the food products in the compartment.

It is another object of the present invention to provide a forced air convection oven which can be easily cleaned.

Accordingly, the present invention provides a forced air convection oven comprising a housing defining a cavity having a front access opening and a centrifugal air circulating blower in the cavity on a horizontal axis located generally centrally of the rear wall of the cavity and electrical resistance type heater means mounted in the cavity adjacent the rear wall for heating air circulated by the blower. An air distributor cage is disposed in the cavity and has a rear panel spaced forwardly from the rear wall of the cavity to define a rear air chamber therebetween, and top, bottom and side panels respectively spaced from the top, bottom and side walls of the cavity to define top, bottom and side air flow passages each communicating with the rear chamber. The rear panel has an air inlet opening registering with the air intake of the blower and the top, bottom and side panels of the cage each have a plurality of air discharge openings for discharging air from the associated air flow passages into the interior of the cage for flow through the cage and back through the air inlet opening in the rear panel to the blower. A food tray support rack is provided in the cage for supporting food products to be heated and cooked.

In accordance with another aspect of the present invention, the air distribution cage is removable as a unit through the access opening in the oven cavity and the food tray support rack is removable through the open front of the cage unit. This not only enables cleaning of the cage unit and support rack external of the housing, but also provides access to the walls of the oven cavity for cleaning.

In accordance with still another aspect of the present invention, the food tray support rack is rotated in the cavity about a vertical axis to continuously change the angular position of the food products in relation to the hot flows from the discharge openings in the top, bottom and side panels to the rear inlet opening in the cage.

DESCRIPTION OF THE PREFERRED EMBODIMENT

Figure 1:
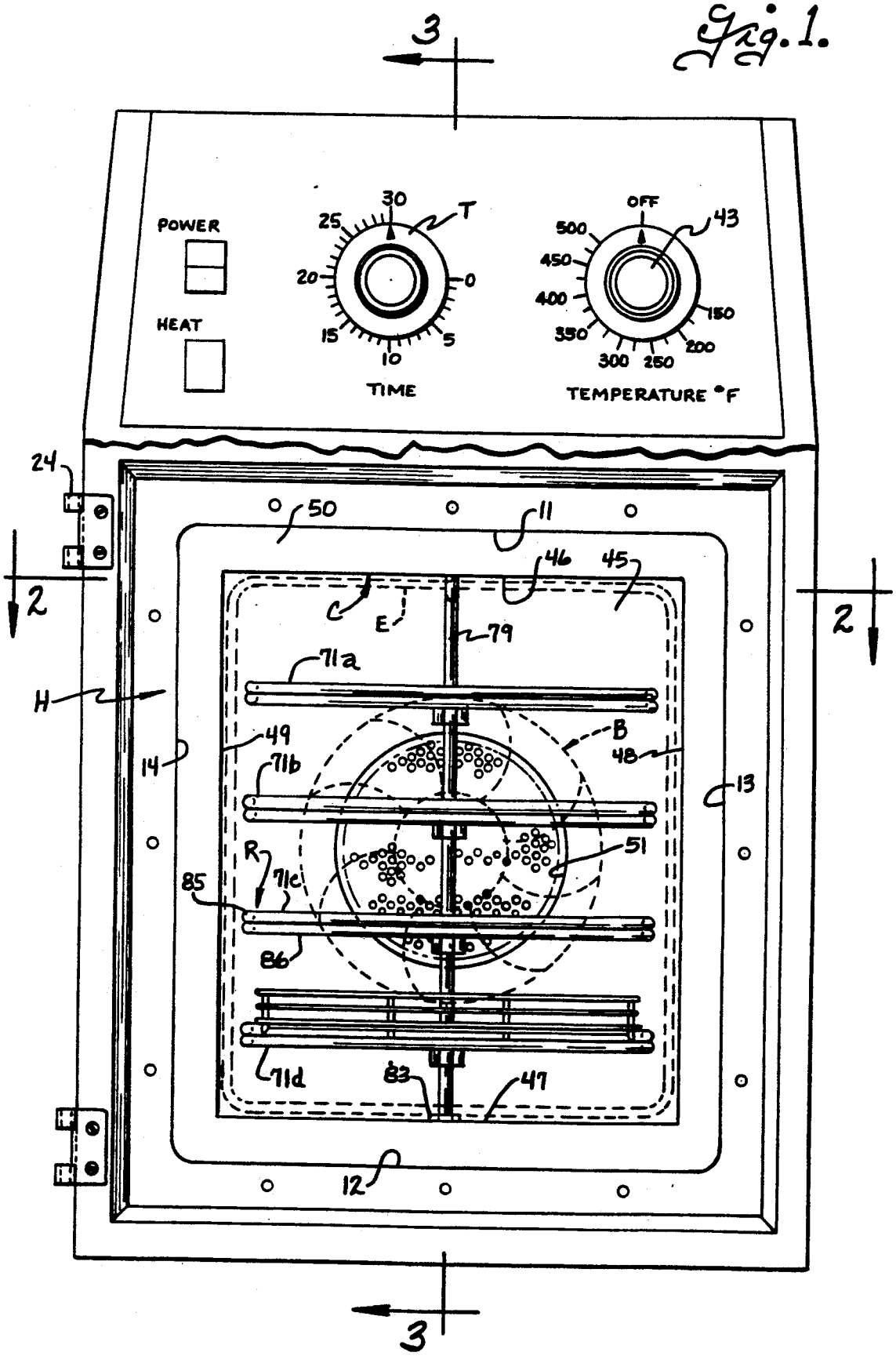
FIG. 1 is a front view of a forced air convection air oven embodying the present invention, with the door removed.

The forced air convection oven in general includes a thermally insulated housing H defining an oven cavity with a front access opening; a door D for closing the access opening; a blower B mounted for rotation on a horizontal axis generally centrally of the rear wall of the oven cavity; an electrical heater E for heating the air circulated by the blower; an air distributor cage unit C removably mounted in the oven cavity, and a food tray support rack R for supporting food products in the oven cavity. The food tray support rack is advantageously mounted for rotation about a vertical axis.

The thermally insulated housing defines an oven cavity having a rear wall 10, and a top wall 11, bottom wall 12, and opposed side walls 13 and 14 extending forwardly from the rear wall and terminating in a front access opening 0 opposite the rear wall. The walls 10–14 of the oven cavity are formed of sheet metal and are surrounded by thermal insulation 15 and enclosed in an outer casing F, also preferably of sheet metal. The door D is also thermally insulated and, as shown, includes outer and inner walls 21, 22 and thermal insulation 23 between the walls. The door is mounted as by hinges 24 for movement between a closed position extending across the access opening 0, and an open position and a latch 25 is provided for latching the door in its closed position.

Figure 3:
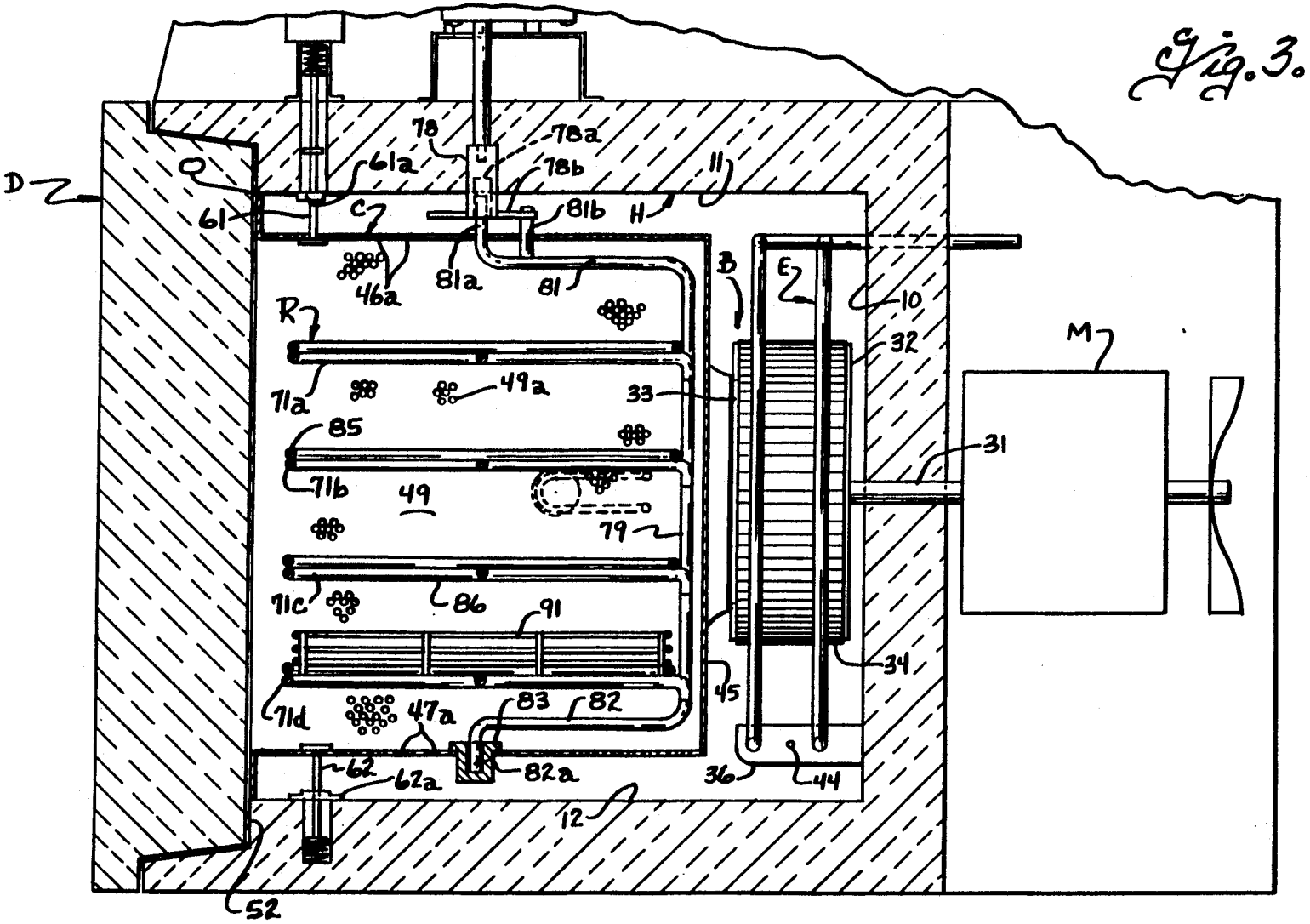
FIG. 3 is a vertical sectional view taken on the plane 3—3 of FIG. 1.
Figure 4:
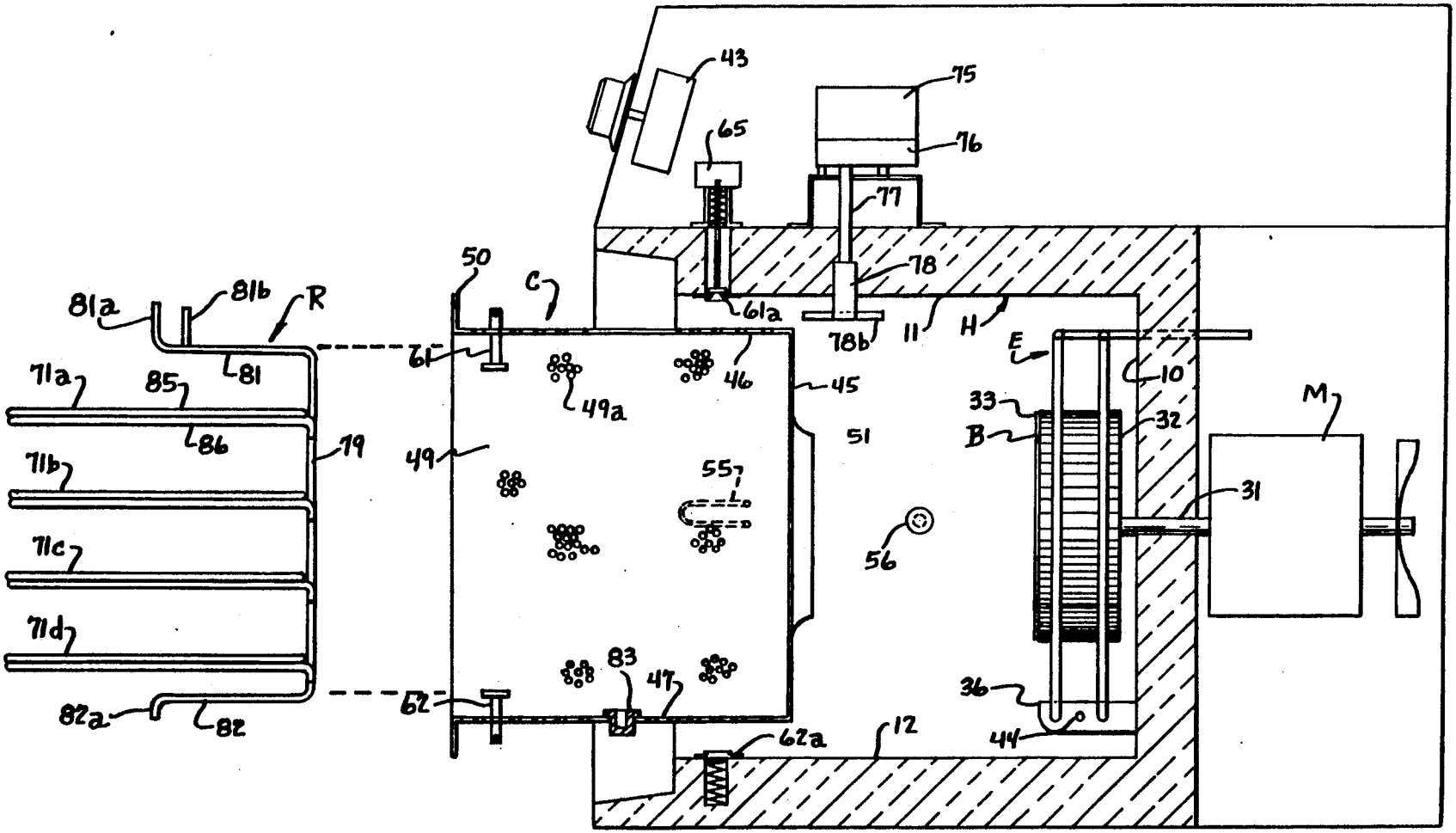
FIG. 4 is a vertical sectional view illustrating assembly and disassembly of air distributor cage and food tray support rack from the oven cavity.

A blower drive motor M is mounted on the housing at the side of the rear wall opposite the oven cavity and has a horizontal output shaft 31 that extends through the rear wall 10 of the oven cavity at a location generally centrally of the rear wall. The blower B is mounted on the shaft 31 for rotation by the motor M and has a generally imperforate wall 32 at the end adjacent the rear wall 10 of the cavity, an annular ring 33 at the opposite end defining a blower air intake opening, and a plurality of blades 34 that extend between the wall 32 and ring 33 for drawing air in through the blower air intake and discharging air centrifugally outwardly from the blower. The electric resistance type heater means E are preferably shaped into a loop and are mounted as by a bracket 36 to extend around the blower to heat the air discharged from the blower. The heater elements E may, for example, have a generally rectangular configuration as shown in FIG. 1, or a circular configuration. Energization of the resistance heater E is controlled by an adjustable temperature controller 43 having a temperature sensor 44. The temperature sensor is preferably mounted at a location to sense the temperature of the heated air discharged from the blower and, as best shown in FIGS. 3 and 4, is conveniently mounted on the bracket 36 at a location spaced from the resistance type heater elements so as to respond to the temperature of the heated air.

Figure 2:
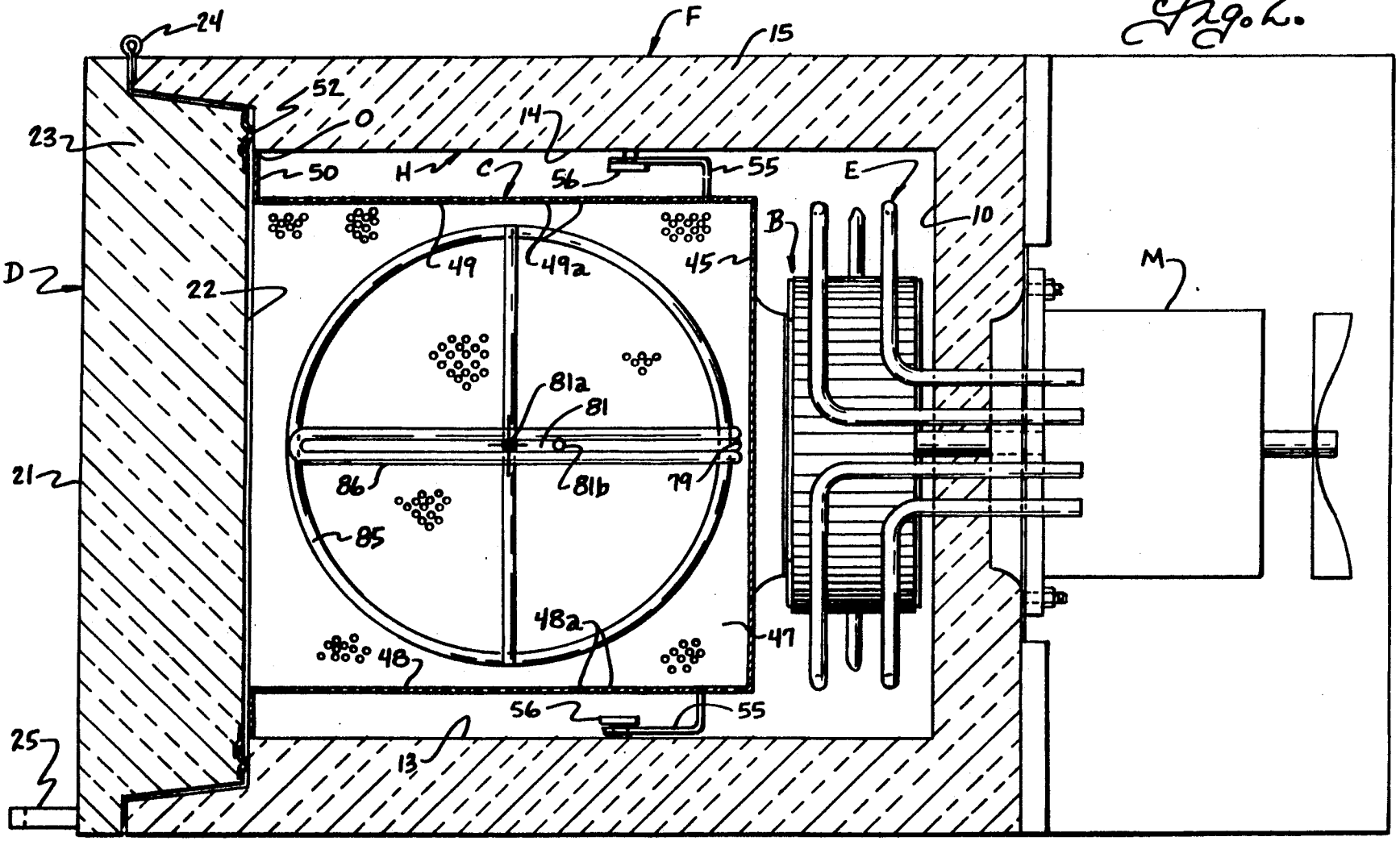
FIG. 2 is a horizontal sectional view taken on the plane 2—2 of FIG. 1.

The air distributor cage C is constructed and arranged to distribute the air from the blower B into the top, bottom and opposed side of the oven cavity. The air distributor cage is advantageously constructed for installation and removal as a unit from the oven cavity, to facilitate cleaning of the cage unit and oven cavity. The cage unit includes a rear panel 45 and a top panel 46, bottom panel 47, and opposed side panels 48 and 49 that extend forwardly from the rear panel. The cage unit is open at the front side and the height, width and depth of the cage unit is less than that of the oven cavity. Means are provided for removably supporting the cage unit in the oven cavity with the rear panel 45 spaced forwardly from the rear wall 10 of the cavity to define a rear air chamber therebetween, and with the top panel 46, bottom panel 47 and side panels 48 and 49 respectively spaced from the top wall 11, bottom wall 12 and side walls 13, 14 of the cavity to define top, bottom and side air flow passages, each communicating at the rear ends with the rear chamber. The rear panel 45 of the cage unit has an air return opening 51 therein that registers with the air intake of the blower and the rear wall is otherwise substantially imperforate. The top, bottom, and side panels 46–49 of the cage unit each have a multiplicity of air discharge openings designated **46*a*–49*a* respectively therethrough for discharging air from the associated top, bottom and side air flow passages into the cage for flow through the interior of the cage unit and back through the air return opening in the rear panel to the intake of the blower. The air discharge openings 46*a*–49*a* are preferably distributed generally uniformly over the associated panel and the combined area of the discharge openings in each panel is preferably in the range of 40% to 65% of the total area of the panel. The top, bottom and side panels may conveniently be formed of uniformly perforated metal sheet having a hole size in the range between 3/16 inches and 5/16 inches. The top, bottom and side panels of the cage are preferably spaced inwardly from the respective top, bottom and side walls of the cavity approximately the same distance, for example of the order of 1 or 1 ½ inches to distribute the air discharged from the blower generally uniformly around the top and bottom and sides of the cage unit. An outwardly extending flange 50 is advantageously provided at the forward end of the cage unit and dimensioned to extend outwardly toward the associated wall of the cavity to aid in locating the cage unit in the cavity and to inhibit air flow out of the front end of the air flow passages. The door D, when in its closed position, extends across the access opening in the cavity and across the open end of the cage unit so that any air that may pass between the forward end of the cage unit and the cavity will be directed back into the open end of the cage unit and flow back through the cage unit to the return opening in the rear panel. As best shown in FIGS. 2 and 3, the door is sealed to the housing outwardly of the access opening by a resilient gasket 52. The rear portion of the cage is removably supported in the oven cavity as by wire clips 55 attached to the side panels of the cage unit at the outer sides thereof and which are arranged to engage support spools 56 on the inner faces of the side walls of the cavity. As will be seen, the clips 55 are arranged to straddle the knobs 56** to support the rear portion of the cage unit while allowing the cage unit to be removed and installed through the forward access opening in the cavity.

An interlock means is advantageously provided to correctly align and to prevent accidental or untentional removal or dislodgment of the cage unit from the oven cavity. As best shown in FIGS. 3 and 4, upper and lower mechanical interlocks or latches designated 61 and 62 are provided and are operable between a lock position preventing removal of the cage unit from the housing and a release position permitting removal of the cage unit from the housing. The interlock units 61 and 62 may, for example, comprise an elongated rod member that is insertable through an opening in a panel of the cage unit and which has a keyed end that is insertable into a receiver **61*a*, 62*a* on the housing, and which rod locks the member against withdrawal in response to turning of the rod member relative to the receiver. In accordance with the present invention, a switch means 65 is associated with at least one of the interlock means 61** and is electrically connected to interrupt power to the heater E and drive motor M when the mechanical interlock means is moved to its release position, to thereby prevent inadvertent operation of the motor or heater during cleaning.

The food tray support rack R is mounted for installation and removal through the open front of the cage unit. The rack is supported for rotation about a vertical axis and is driven by a rack drive motor 75 through a speed reducer 76. The rack drive motor is mounted on the housing outside the cavity and has a drive shaft 77 that extends downwardly through the housing and a drive head 78 non-rotatably secured to the lower end of the drive shaft. The rack means includes a plurality of tray holders, herein shown four in number and designated **71*a*–71*d*, each having a generally annular outer periphery. A tray holder mounting means is provided for supporting the tray holders for rotation about a vertical axis generally coaxial of the annular periphery of the tray holders in a manner which does not obstruct positioning of food trays on the tray supports. The tray holder means includes a generally upright member 79 that is fixed to the tray holders adjacent their outer peripheries and which supports the tray holders in cantilever fashion in vertical spaced relation, and upper and lower arms 81, 82 that extend inwardly from the upper and lower ends of the member 79 and terminate in respective upwardly and downwardly extending trunnions 81*a* and 82*a*. The lower trunnion 82*a* is supported in a bearing 83 on the bottom panel of the cage and a means is provided for detachably coupling the upper end of the rack to the drive head 78. In the preferred embodiment illustrated, the drive head 78 is formed with a socket 78*a* (FIG. 3) which is sufficiently deep to allow the upper trunnion 81*a* to be inserted into the socket in the drive head and the rack then raised to a level such that the lower trunnion can be moved into alignment with the lower bearing. The rack can then be allowed to move downwardly into the lower bearing. Detachable coupling means are provided for drivingly connecting the drive head and rack support, to rotate the rack in one direction when the drive motor is energized, and which detachable coupling means is arranged to permit limited angular movement of the rack support relative to the drive motor in a direction opposite the drive direction such that the rack can be manually rotated a limited amount when the drive motor is stopped to enable positioning of the upright member 79 of the rack away from the open front of the cage unit. In the embodiment illustrated, the detachable coupling includes a cross pin 78*b* fixed to the drive head 78 and a drive pin 81*b* spaced outwardly from the trunnion 81*a* and arranged to be drivingly engaged by the cross pin 78*b*. When the drive motor is energized, the cross pin 78*b* will engage the drive pin 81*b* and rotate the rack in one direction. If the motor is stopped when the support bar 79** is adjacent the front opening in the cage, the cage can be manually rotated in a direction opposite the direction of rotation of the rack by the drive motor, through at least 180° to enable movement of the upright support member away from the open front of the cage.

The tray holders **71*a*–71*d* are of an open construction so as to minimize obstruction of air flow therethrough and, as shown, include an annular portion or circular ring 85 with one or more cross members 86 for supporting trays 91 for food products and to aid in maintaining the rings in shape. The forced air convection oven is particularly adapted for reconstituting precooked fried foods such as french fries and chicken nuggets and, for this purpose, the food trays shown at 91 in FIG. 3** are preferably in the form of open mesh or open grid type baskets to allow air flow therethrough.

A manually presettable timer T (FIG. 1) is provided for timing a heating cycle and may be of the type which actuates a visual and/or audible alarm. The timer can also be arranged to interrupt power to the heater and blower at the end of a heating cycle.

From the foregoing it is believed that the construction and operation of the forced air convection oven will be readily understood. The air distributing cage has a multiplicity of air discharge openings in the top, bottom and side panels and a return opening in the rear panel and is mounted in the oven so that air discharged from the blower and heated by the electrical heating element passes in through the openings in the top, bottom and side panels of the cage to the interior of the cage and flows through the cage through the return outlet in the rear wall to the intake opening of the blower. The food support rack is rotated during operation of the oven to continuously change the angular position of the food articles in relation to the hot air flow from the top, bottom and side panels to the rear return opening in the cage. The support rack is insertable and removable through the open front of the cage and the cage is adapted to be inserted and removed as a unit from the oven cavity so that both the cage and rack can be cleaned outside of the housing. Moreover, removal of the rack and cage from the oven cavity also provides unobstructed access to the walls of the cavity for cleaning.

The food in the trays on the food tray support rack is exposed to evenly distributed flow of relatively high velocity air preferably in the range of 1500 to 2500 feet per minute. The food placed in the trays heats up quickly and evenly since the hot air is directed such that almost all of the exposed surfaces of the food are in contact with this high velocity air for almost all of the cooking time. This provides uniform browning of food being cooked. Further the high velocity hot air impinges upon the food from a continuously varying direction, due to the rotation of food tray, resulting in a continuously varying velocity vector impact. The high velocity hot air evaporates moisture on the exposed surfaces quickly and forms a thin exterior skin which is crisp while the interior of the food is heated to 180° F.

The oven is especially adapted to cook french fries which have been twice blanched, once after partial frying. These french fries are cooked quickly with high quality crisp exterior and moist interior, without deep fat frying in hot oil. Typically a serving of such french fries can be cooked from the frozen state in 2 178 to 3 ½ minutes.

Similarly, other previously cooked food such as hors d'oeuvre, pizza, sandwiches, previously fried and frozen chicken nuggets, mushrooms, cauliflowerets, whole or pieces of chicken, fish, hamburgers, pretzels, cookies, can also be reconstituted without loss of perceived quality.

The embodiments of the invention in which an exclusive property or privilege is claimed are defined as follows:

1. An oven for cooking food products comprising:

1) a thermally insulated housing defining a cavity having a rear wall and a top wall, a bottom wall and opposed side walls extending forwardly from the rear wall, and a front access opening opposite said rear wall;

b) a centrifugal air circulating blower in the cavity on a horizontal axis located generally centrally on said rear wall and blower motor means on the rear wall at a side thereof opposite said cavity for rotating the blower, the blower having an axial air intake at a forward side thereof and blades for discharging air centrifugally outwardly from the blower;

c) heater means mounted on the cavity adjacent the rear wall for heating air circulated by the blower;

d) an air distributor cage unit disposed in the cavity and removable as a unit through the front access opening for cleaning, the cage unit including a rear panel, a top panel, a bottom panel and opposed side panels extending forwardly from the rear panel, and an open front, means removably supporting said cage unit in the cavity with the rear panel spaced forwardly from the rear wall to define a rear air chamber therebetween and with the top, bottom and side panels respectively spaced from the top, bottom and side walls of the cavity to define top, bottom and side air flow passages therewith each communicating with the rear chamber, the rear panel having air return opening means registering with the air intake of the blower, the top, bottom and side panels of the cage unit each having a multiplicity of air discharge openings for discharging air from the associated top, bottom and side air flow passages into the cage unit for flow through the interior of cage unit and back through the air return opening in the rear panel to the blower;

e) food tray support rack means in said cage unit and removable through the open front of the cage unit, and f) door means mounted on the housing for movement into and out of a closed position extending across said access opening in the housing and across said open front of the cage unit.

2. An oven according to claim 1 wherein the means for removably supporting the cage unit in the cavity includes interlock means engageable with said cage unit and said housing and operable between a lock position preventing removal of the cage unit from the housing and a release position permitting removal of the cage unit from the housing, and means including switch means actuated by said interlock means for preventing operation of said heater means and said motor means when said interlock means is operated to said release position.

3. An oven according to claim 1 including means supporting said rack means for rotation about a vertical axis, rack drive motor means mounted on the housing outside said cavity, and means detachably coupling said rack means to said rack drive motor means for rotation thereby.

4. An oven according to claim 1 wherein said rack means includes at least two food tray holders each having a generally annular outer periphery, tray holder mounting means for supporting tray holders for rotation about a vertical axis generally coaxial of the annular periphery of the tray holders, said tray holder mounting means including a generally upright member fixed to the tray holders adjacent their outer peripheries and supporting the tray holders in vertically spaced relation, rack drive motor means mounted on the housing outside the cavity, and means detachably coupling said rack means to said drive motor means for rotation thereby in one direction when the drive motor is energized, said detachable coupling means being constructed and arranged to permit limited angular movement of the rack support means relative to said drive motor means in a direction opposite said one direction such that the rack means can be manually rotated a limited amount when the drive motor means is stopped, to enable positioning the generally upright member away from the open front of the cage unit.

5. An oven according to claim 1 wherein the air discharge openings in each the top, bottom and side panels of the cage unit are distributed generally uniformly over the associated panel.

6. An oven according to claim 1 wherein the combined area of the air discharge openings in each panel is in the range of 40% to 65% of the total area of the panel.

7. An oven according to claim 6 wherein the top panel, bottom panel and side panels of the cage are formed of uniformly perforated metal sheet having a hole size in the range between 3/16 inches to 5/16 inches.

8. An oven according to claim 1 wherein said heater means is shaped to extend around the blower at a location spaced outwardly from the outer periphery of the blower.

* * * * *